United States Patent [19]

Young

[11] 4,226,336

[45] Oct. 7, 1980

[54] APPARATUS FOR DISPENSING THE CONTENTS OF A TUBE HAVING A MOVABLE PLATEN

[76] Inventor: Harold A. Young, 2500 Venice Dr., Schererville, Ind. 46375

[21] Appl. No.: 66,578

[22] Filed: Aug. 15, 1979

[51] Int. Cl.[3] ..... B65D 35/28

[52] U.S. Cl. ..... 222/102; 222/105

[58] Field of Search ..... 222/94, 95, 101, 102, 222/105, 131, 181, 183, 184, 185

[56] References Cited

U.S. PATENT DOCUMENTS

| | | | |
|---|---|---|---|
| 2,168,080 | 8/1939 | Allen | 222/101 |
| 2,570,755 | 10/1951 | Booth | 222/105 X |
| 2,670,876 | 3/1954 | Clouse | 222/102 |
| 3,252,624 | 5/1966 | Watson, Jr. | 222/102 X |
| 4,019,655 | 4/1977 | Moeller | 222/105 X |

*Primary Examiner*—Allen N. Knowles
*Assistant Examiner*—Fred A. Silverburg
*Attorney, Agent, or Firm*—Walter Leuca

[57] ABSTRACT

This invention is a tube compressing apparatus. It dispenses the contents of a tube by compressing the tube between rollers. It comprises a housing having fixed at one end a spout to which the open end of a tube is connected. The sealed end of a tube is supported by a clamp provided at the other end of the housing. A platen having a rack bar is supported for reciprocal movement in the housing. A second rack bar is fixed to the sides of the housing. A roller support platen intermediate the housing ends proceeds to compress the tube from the sealed end to the end connected to the spout. This is accomplished by providing a ratchet on the roller support platen which engage the reciprocally movable rack bars carried by the first mentioned platen when moving in the downward direction but is released when moving in the upward direction. A second ratchet is provided on the roller support platen which engages the second rack bar fixed to the sides of the housing to prevent any upward movement of the roller support platen but is released when the roller support platen is moving in the downward direction.

10 Claims, 11 Drawing Figures

Fig.-1
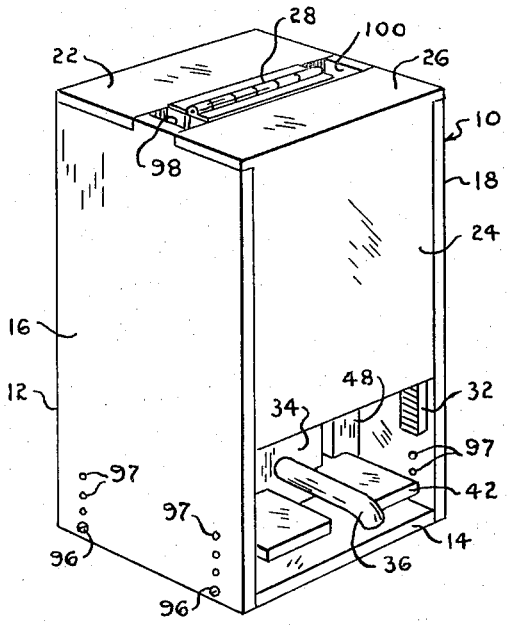
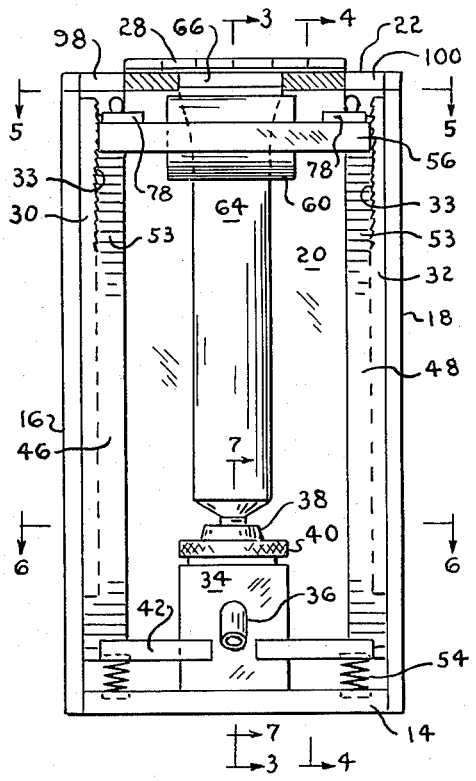
Fig.-2
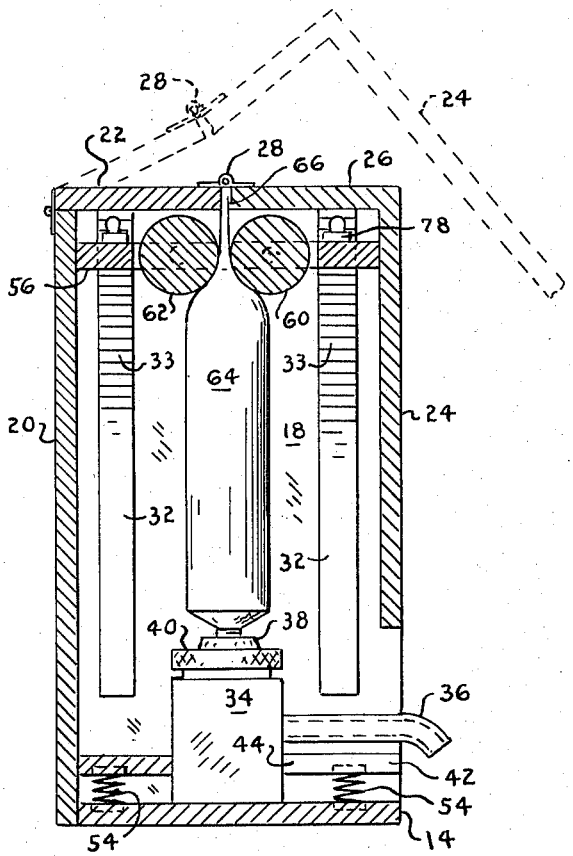
Fig.-3
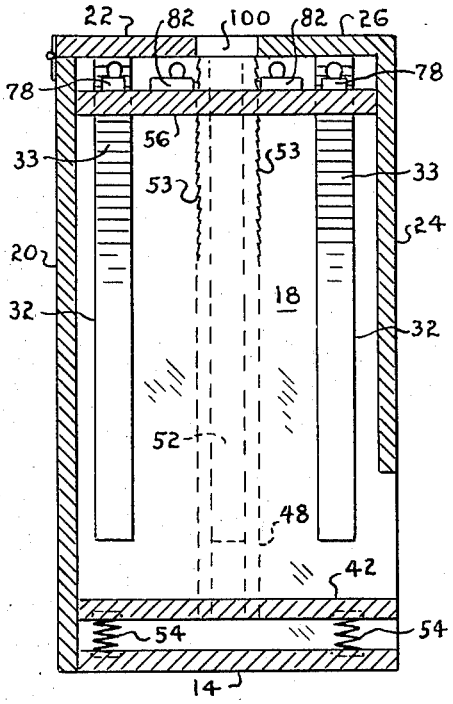
Fig.-4

APPARATUS FOR DISPENSING THE CONTENTS OF A TUBE HAVING A MOVABLE PLATEN

BACKGROUND OF THE INVENTION

1. Field of the Invention

This invention relates to dispensing devices generally and more particularly to an apparatus for dispensing the contents of a tube such as a toothpaste tube and the like.

2. Description of the Prior Art

Roller squeezing tube type dispensers of the prior art that I am familiar with are complicated in structure and operation and are not economical to manufacture nor easy to operate. Additionally, prior art devices to which this invention pertains do not adequately provide for size variations of different tubes and consequently, are limited in application.

SUMMARY OF THE INVENTION

The tube dispensing apparatus of my invention comprises a housing for supporting therein a tube in an inverted position. The open end of said tube is threadedly connected to a spout device fixed to the base of the housing. The sealed end of the tube is clamped between a hinge connecting the top and door part of the housing. A spring supported platen carrying upright rack bars at opposing sides thereof is positioned over the base of the housing. The platen and upright rack bars are vertically movable by application of manual pressure on the platen and the return bias of the spring support. A second platen carrying tube compressing rollers engages the tube body adjacent the sealed end thereof and descends over the tube with incremental movement compressing the contents of said tube through the spout device. The incremental descending action of the second platen is accomplished by providing ratchet devices thereon which engage the teeth of upright rack bars. Other rack bars are fixed on the interior sides of the housing. Other ratchet devices on the second platen engage the teeth of these rack bars to prevent upward movement of the second platen while the upright rack bars move upwardly to engage the ratchet devices at a lower incremental position on the upright rack bars preparatory for further incremental descension.

Other objects and advantages of my invention will become more apparent after a careful study of the following detailed description taken together with the accompanying drawings which illustrate a preferred embodiment of my invention.

BRIEF DESCRIPTION OF THE DRAWINGS

FIG. 1 is a perspective view of this invention;

FIG. 2 is a front elevation of this invention with the front cover removed at the top hinge connection;

FIG. 3 is a side elevation longitudinally sectioned along lines 3—3 of FIG. 2;

FIG. 4 is another side elevation longitudinally sectioned along lines 4—4 of FIG. 2;

DESCRIPTION OF THE PREFERRED EMBODIMENT

Figure 7:
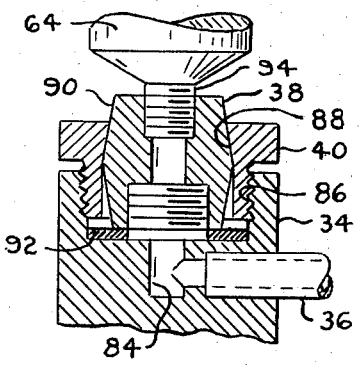
FIG. 7 is a longitudinal section of the spout device of this invention taken along lines 7—7 of FIG. 2.

Referring now more particularly to the drawings wherein is illustrated the preferred embodiment of my invention, numeral 10 designates generally this invention. It comprises a housing 12 constructed to include a horizontally displaced base 14, upstanding sides 16 and 18, back side 20, a hinged top 22 and a hinged front cover 24 having integrally formed therewith a frontal half top 26 connected to half top 22 by means of hinge 28. Further, sides 16 and 18 are provided with upright parallel spaced rack bars 30 and 32 respectively each having teeth 33 a major length thereof. Base 14, as more clearly shown in FIGS. 2 and 3, has mounted thereon block 34 which carries spout 36 and bushing connectors 38 and 40, the details of which are best illustrated in FIG. 7. Movable platen 42 is provided in housing 12 and is formed with an opening 44 for circumscribing the outline of spout 36 and block 34 with sufficient clearance to be movable relative thereto and also guided thereby. The sides of platen 42 carry upright rack bars 46 and 48 centrally positioned and slidingly movable on upright guide bars 50 and 52 fixed to housing sides 16 and 18, respectively. Teeth elements 53 for incremental ratchet engagement are provided on opposing sides of upright bars 46 and 48. Platen 42 and upright bars 46 and 48 connected thereto are supported at a spaced elevation relative to base 14 by means of springs 54 which permit up and down movement thereof.

Figure 5:
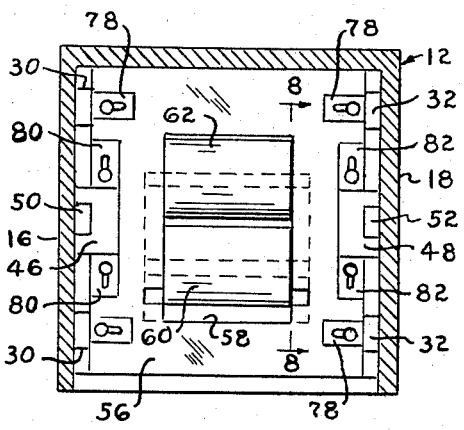
FIG. 5 is a cross sectional elevation taken along lines 5—5 of FIG. 2.
Figure 6:
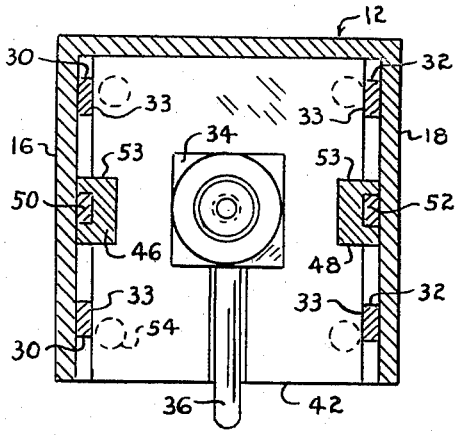
FIG. 6 is a cross sectional elevation taken along lines 6—6 of FIG. 2.
Figure 8:
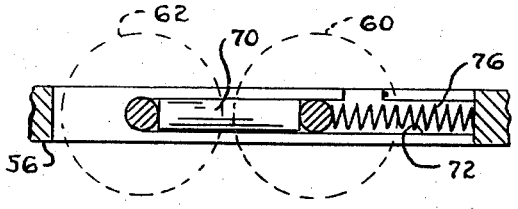
FIG. 8 is a detail view of this invention taken along lines 8—8 of FIG. 5.
Figure 9:
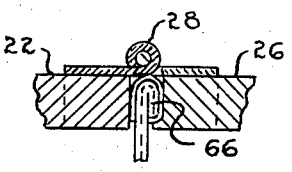
FIG. 9 is a cross section of the hinged portion of the cover showing in detail the clamping action of the cover against the sealed end of the tube.
Figure 11:
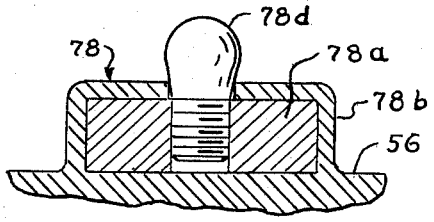
FIG. 11 is a cross sectional view taken along lines 11—11 of FIG. 10.

Roller supporting platen 56, as more clearly shown in FIGS. 2 and 5, is provided with a rectangular aperture 58 in which are journaled rollers 60 and 62, the detail axle arrangement therefor is more clearly shown in FIG. 8. It is understood that any convenient axle arrangement may be provided so that rollers 60 and 62 may sufficiently compress tube 64 placed therebetween to expel the contents thereof, and also to be movable to admit the thicker sealed end 66 of tube 64 between the rollers so that the sealed end 66 may be clamped between the hinged ends of half top 22 and frontal half top 26 of housing 12. I accomplish this by providing, as shown in FIG. 8, a spacer 70 fitted in end grooves 72 formed in the opposing side edges of rectangular aperture 58 which serves to properly position the axles of rollers 60 and 62.

Springs 76 are provided in end grooves 72 to bias the axle of rollers 60 and 62 toward a tube compressing position, permitting separation between the rollers when necessary to permit passage of the thicker sealed end 66 of tube 64.

Mounted on the top side of roller platen 56 are teeth engaging ratchet devices 76 and 78, and teeth engaging ratchet devices 80 and 82 which are grouped in pairs and operate to engage the teeth elements 33 of upright bars 30, 32 fixed to sides 16 and 18 of housing 12, and teeth elements 53 of upright bar 46 and 48, respectively. As more clearly shown in FIG. 10, teeth ratchet devices 76, 78, 80 and 82 are essentially similar in that they are formed in any convenient manner to provide a spring biased detent **78*a* movable in and out of the housing 78*b***.

Figure 10:
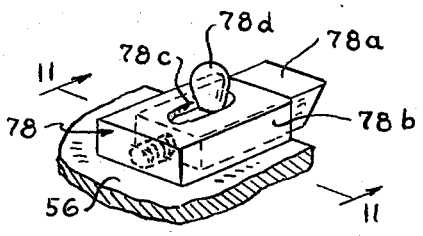
FIG. 10 is a pictorial illustration of the ratchet means provided on the roller platen.

Slot 78*c* in housing 78*b* is formed to admit a tapered knob screw 78*d* which is dimensioned to wedge against slot 78*c* when rotated. FIG. 10 illustrates a ratchet device 78 showing how detent 78*a* may be locked in a retracted position when disengaged from any of the upright rack bars in order to freely lift roller platen 56 from a lowered position. Unscrewing tapered knob screw 78*d* releases detent 78*a* from its retracted position to allow rack engagement. Other similar ratchet type devices, of course, may be provided to obtain the same result.

Block 34 which is provided with a right angled passageway 84 to which is connected exit spout 36 is threaded as at 86 for receiving a threaded bushing 40. The center hole of bushing 40 is formed with an annular taper as at 88 at one end. The other end is not tapered. The bushing 40 internally receives a coupling member 38, the external surface of which is tapered as at 90 which mates with annular taper 84 by which means bushing 40, upon being threaded in block 34 will wedge against and tighten coupling 38 against seal 92 to provide a sealed connection even though coupling 38 and tube 64 may be rotated either way so that the sealed end 66 of the tube may be aligned parallel between rollers 60 and 62. Each end of coupling 38 is further provided with threaded holes of different dimension to accommodate different size tube openings 94.

Base 14, as shown in FIG. 1, is connected to sides 16 and 18 of housing 12 by means of screws 96 which are easily removable. A series of holes 97 are further provided in sides 16 and 18 through which screws 96 are inserted to support base 14 at adjustable elevations to accommodate different length tubes 64.

Since varying the elevation of base 14 also varies the elevation of platen 42 and rack bars 46 and 48 fixed thereto, top halves 22 and 26, as well as hinge 28 are formed with cut-outs as at 98 and 100 adjacent sides 16 and 18 respectively, as more clearly shown in FIGS. 1 and 2. Cut-outs 98 and 100 are provided to allow bars 46 and 48 to enter therein in the event base 14 and platen 42 are fixed at an elevated position.

The mode of operation of this invention is as follows: With door 24 open as shown in dotted lines of FIG. 3, and roller platen 56 in the uppermost position, or even removed therefrom, the open end of tube 64 is screwed and tightened into a threaded end of coupling 38. Prior to tightening bushing 40 to seal the connection, tube 64 is rotated to align the sealed end 66 in a direction parallel to rollers 60 and 62. Sealed end 66 of tube 64 is inserted between rollers 60 and 62 with spring means 76 allowing resilient back movement to roller 60 to permit entry of the conventionally formed sealed end of the tube. With the tube end thus inserted and roller platen 56 horizontally positioned in place whereby detent elements 78*a* of ratchet devices 78, and like detent elements of ratchet devices 76, 80 and 82, are in engagement with the teeth of the rack bars 30, 32, 46 and 48, door 24 together with hinged tops 22 and 26 are closed. In the closing process, hinged tops 22 and 26 clamp onto the sealed end 66 of tube 64 at hinge 28. To dispense the contents of tube 64, the operator of this apparatus manually presses on movable platen 42 against the bias of springs 54, moving platen 42 and rack bars 46 and 48 fixed thereto, downwardly. Ratchet devices 80 and 82 engage teeth 53 on the sides of bars 46 and 48 to move roller platen 56 downwardly, but releases engagement therewith when platen 42 returns upwardly to its original position by means of springs 54 when the operator releases the downward pressure on platen 42. During the downward movement of roller platen 56, with tube 64 in a fixed position between its clamped sealed end 66 and its open end screwed into block 34, rollers 60 and 62 will operate to compress tube 64 to expel its contents through passageways 84 of block 34 and out of spout 36. Roller platen 56 is prevented from moving upwardly or backtracking, after each incremental downward movement because ratchet devices 76 and 78 engage teeth 33 of rack bars 30 and 32 fixed to sides 16 and 18 allows downward movement only.

When the contents of tube 64 are entirely expelled and roller platen 56 is at its most depressed position, door 24 is opened thereby releasing the clamp of hinge 28 on end 66 of tube 64. The ratchet devices 76, 78, 80 and 82 are released from their engagement with rack bars 30, 32, 46 and 48 respectively, by retracting detents 78*a* of each of the ratchet devices. Detents 78*a* are locked in the retracted position by tightening knob 78*d* causing it to wedge against slot 78*c* as heretofore explained.

The ratchet devices being thus disengaged, platen 56 is raised, allowing tube 64 to be removed from between rollers 60 and 62. Tube 64 is now thus free to be unscrewed from coupling 38 of block 34 and discarded.

I claim:

1. A tube compressing apparatus, comprising:
a housing;
spout means in said housing fixed at one end thereof, said spout means having means for connecting an open end of a tube;
clamp means in said housing fixed at the other end thereof, said clamp means operable to hold the sealed end of the tube;
first rack bar means mounted on a movable platen in said housing for reciprocal movement intermediate said spout means and said clamp means;
second rack bar means fixed to said housing intermediate said spout means and said clamp means;
roller support means in said housing intermediate said spout means and said clamp means for compressing the tube connected between said spout means and said clamp means;
first ratchet means on said roller support means engaging said first rack bar means to move said roller support means in one direction of said reciprocating movement of said first rack bar means; and
second ratchet means on said roller suppport means engaging said second rack bar means to prevent said roller support means from moving in the other direction of said reciprocating movement of said first rack bar means.

2. The apparatus of claim 1 wherein said spout means is further characterized as having a passageway therethrough, one end of said passageway being a spout, the other end of said passageway being enlarged and threaded, a bushing member having a tapered bore threaded into said other end of said passageway, and a coupling member having a longitudinally tapered surface for mating with said tapered bore of said bushing.

3. A tube compressing apparatus, comprising:
a housing composed of base, side, top and door members;
a spout discharge assembly mounted on said base;
a first platen supported for reciprocating movement over said base;

upright rack bars fixed to said platen and longitudinally movable relative to said side members of said housing;

rack bars fixed to said sides of said housing disposed parallel to said upright rack bars fixed to said first platen;

a second platen, said second platen having an aperture, rollers journaled in said aperture, first ratchet means fixed on said second platen for unidirectional engagement with said upright rack bars, and second ratchet means fixed on said second platen for unidirectional engagement with said rack bars fixed to said sides of said housing; and clamp means on said top member of said housing for securing the sealed end of a tube.

4. The apparatus of claim 3 wherein said clamp means is further characterized as being a hinge connection between said top and said door members.

5. The apparatus of claim 3 wherein said spout discharge assembly is further characterized as having a passageway therethrough, one end of said passageway being a spout, the other end of said passageway being enlarged and threaded, a bushing member having a tapered bore threaded into said other end of said passageway, and a coupling member having a longitudinally tapered surface for mating with said tapered bore of said bushing.

6. The apparatus of claim 3 wherein said first platen is further characterized as being supported over said base by spring means, said first platen having an aperture through which said spout discharge assembly extends, and said upright rack bars being fixed to said first platen at opposite sides thereof.

7. The apparatus of claim 4 wherein said second platen is further characterized as having spring means for biasing said rollers together.

8. The apparatus of claim 4 wherein said spout discharge assembly is further characterized as having a passageway therethrough, one end of said passageway being a spout, the other end of said passageway being enlarged and threaded, a bushing member having a tapered bore threaded into said other end of said passageway, and a coupling member having a longitudinally tapered surface for mating with said tapered bore of said bushing.

9. The apparatus of claim 8 wherein said first platen is further characterized as being supported over said base by spring means, said first platen having an aperture through which said spout discharge assembly extends, and said upright rack bars being fixed to said first platen at opposite sides thereof.

10. The apparatus of claim 9 wherein said second platen is further characterized as having spring means for biasing said rollers together.

* * * * *